US008613804B2

(12) United States Patent
Douglas et al.

(10) Patent No.: US 8,613,804 B2
(45) Date of Patent: Dec. 24, 2013

(54) SYSTEM AND METHOD FOR DRY CLEANING ARTICLES

(75) Inventors: James E. Douglas, El Dorado Hills, CA (US); Wolf-Dieter R Berndt, Reno, NV (US)

(73) Assignee: Greenearth Cleaning, LLC, Kansas City, MO (US)

( * ) Notice: Subject to any disclaimer, the term of this patent is extended or adjusted under 35 U.S.C. 154(b) by 0 days.

(21) Appl. No.: 13/352,875

(22) Filed: Jan. 18, 2012

(65) Prior Publication Data

US 2012/0260435 A1 Oct. 18, 2012

Related U.S. Application Data

(62) Division of application No. 11/471,143, filed on Jun. 19, 2006, now Pat. No. 8,123,819.

(60) Provisional application No. 60/692,692, filed on Jun. 20, 2005.

(51) Int. Cl.

| | |
|---|---|
| ***B08B 7/00*** | (2006.01) |
| ***D06L 1/00*** | (2006.01) |
| ***D06F 35/00*** | (2006.01) |
| ***B01D 24/46*** | (2006.01) |
| ***B01D 37/02*** | (2006.01) |

(52) U.S. Cl.

USPC ..... 134/10; 134/42; 8/142; 8/158; 8/159; 210/670; 210/791; 210/777; 210/778

(58) Field of Classification Search

None

See application file for complete search history.

(56) References Cited

U.S. PATENT DOCUMENTS

| | | | | |
|---|---|---|---|---|
| 2,451,715 | A * | 10/1948 | Caldwell | 366/165.2 |
| 3,557,581 | A * | 1/1971 | Donini et al. | 68/18 F |
| 3,907,681 | A * | 9/1975 | Corrigan et al. | 210/777 |
| 5,135,611 | A * | 8/1992 | Cameron | 159/4.1 |
| 5,139,686 | A * | 8/1992 | Cares | 210/797 |
| 5,942,007 | A | 8/1999 | Berndt et al. | |
| 6,042,618 | A * | 3/2000 | Berndt et al. | 8/142 |
| 6,042,681 | A | 3/2000 | Draghetti | |
| 6,460,211 | B1 | 10/2002 | Chapman | |
| 6,569,210 | B1 | 5/2003 | Chao et al. | |
| 6,855,173 | B2 | 2/2005 | Ehrnsperger et al. | |
| 2004/0139555 | A1 | 7/2004 | Conrad et al. | |
| 2004/0173246 | A1 | 9/2004 | Damaso et al. | |
| 2005/0022316 | A1 | 2/2005 | Rawson et al. | |

FOREIGN PATENT DOCUMENTS

| | | |
|---|---|---|
| DE | 2010809 | 9/1971 |
| DE | 3739711 | 6/1989 |
| GB | 1067064 | 5/1967 |

(Continued)

OTHER PUBLICATIONS

Dow Corning Corporation; "Siloxane Assets and Attributes—What Are Siloxane Additives?" (Website); <http://www.dowcorning.com/content/plastics/plassilox/plas_siloxanes1.asp>.

(Continued)

*Primary Examiner* — Nicole Blan

(74) *Attorney, Agent, or Firm* — Lathrop & Gage LLP; Brian C. Trinque

(57) ABSTRACT

Systems and methods for dry cleaning articles using siloxane solvents are provided. In the systems and methods according to the present invention, the siloxane solvent suspends impurities extracted from the articles being cleaned, and the system filters off the impurities, thereby cleaning the articles.

5 Claims, 5 Drawing Sheets

(56) References Cited

FOREIGN PATENT DOCUMENTS

| | | |
|---|---|---|
| JP | 01011599 | 1/1989 |
| JP | 0600-7587 | 1/1994 |
| JP | 2000-197796 | 7/2000 |
| JP | 2002177691 | 6/2002 |
| JP | 2002520508 | 7/2002 |
| WO | WO0148297 | 7/2001 |
| WO | WO03008698 | 1/2003 |
| WO | WO2005003437 | 1/2005 |

OTHER PUBLICATIONS

EPA United States Environment Protection Agency; "Design for the Environment—Siloxane D5 Fact Sheet;" (Website); <http://www.epa.gov/dfe/pubs/garment/d5fs2al.htm>; 2010; USA.

"Google Search—Siloxane;" (Website); <http://www.google.com/search?sourceid= . . . >.

International Search Report Issued for International Application No. PCT/US2006/023948 for Search Completed Oct. 12, 2006 and Mailed Apr. 10, 2007.

* cited by examiner

*FIG. 3*

| GENERATING A REGENERATIVE PRE-COATED FILTER SYSTEM | |
|---|---|
| STEP 1 | POWDER & CLAY INTO BASKET |
| STEP 2 | CENTRIFUGE SPIN DISC FILTERS |
| STEP 3 | DRAIN SOLVENT AND MEDIUM TO VESSEL |
| STEP 4 | REPEAT STEPS 2 & 3 |
| STEP 5 | ADD SOLVENT TO THE CLEANING BASKET AGITATE MIXTURE BY ROTATING BASKET |
| STEP 6 | CIRCULATE FROM BASKET TO FILTER TO BASKET PRECOAT |
| STEP 7 | ALLOW SETTLING OF MIXTURE IN VESSEL TO GRAVITATE TO A TANK THROUGH A BAG |

*FIG. 4*

| UTILIZING A REGENERATIVE PRE-COATED FILTER SYSTEM | |
|---|---|
| STEP 1 | LOAD ITEM TO BE CLEANED INTO THE BASKET |
| STEP 2 | PUMP SOLVENT FROM TANKS TO WHEEL |
| STEP 3 | ADD DETERGENT PLUS OPTIONAL ADDITIVES MILL THIS MIXTURE |
| STEP 4 | REGENERATE THE SOLVENT BY EXPOSURE TO PRE-COATED FILTERS |
| STEP 5 | DRAIN SOLVENT FROM THE BASKET |
| STEP 6 | CENTRIFUGE THE BASKET SO AS TO REDUCE THE VOLUME OF SOLVENT |
| STEP 7 | BEGIN TO RECOVER THE REMAINING SOLVENT BY DRYING AND CONDENSING THE SOLVENT |
| STEP 8 | DURING THE DRYING PROCESS CIRCULATE THE SOLVENT IN TANKS THROUGH THE FILTER |
| STEP 9 | COOL DOWN THE ITEMS CLEANED PRIOR TO REMOVING FROM THE BASKET |

*FIG. 5*

| INTRODUCTION OF INERT GASES | |
|---|---|
| STEP 1 | LOAD ITEM TO BE CLEANED INTO THE BASKET |
| STEP 2 | PUMP SOLVENT FROM TANKS TO WHEEL |
| STEP 3 | INITIATE THE INTRODUCTION OF INERT GAS |
| STEP 4 | ADD DETERGENT PLUS OPTIONAL ADDITIVES MILL THIS MIXTURE |
| STEP 5 | REGENERATE THE SOLVENT BY EXPOSURE TO PRE-COATED FILTERS |
| STEP 6 | TERMINATE THE INTRODUCTION OF INERT GAS |
| STEP 7 | DRAIN THE SOLVENT FROM THE BASKET |
| STEP 8 | CENTRIFUGE THE BASKET SO AS TO REDUCE THE VOLUME OF SOLVENT |
| STEP 9 | BEGIN TO RECOVER THE REMAINING SOLVENT BY DRYING AND CONDENSING THE SOLVENT |
| STEP 10 | DURING THE DRYING PROCESS CIRCULATE THE SOLVENT IN TANKS THROUGH THE FILTER |
| STEP 11 | COOL DOWN THE ITEMS CLEANED PRIOR TO REMOVING FROM THE BASKET |

SYSTEM AND METHOD FOR DRY CLEANING ARTICLES

CROSS-REFERENCE TO RELATED APPLICATION

The present application is a divisional of U.S. patent application Ser. No. 11/471,143, filed Jun. 19, 2006, which issued as U.S. Pat. No. 8,123,819 on Feb. 28, 2012, which claims priority to U.S. Provisional Application No. 60/692,692, filed Jun. 20, 2005. The entire contents of the aforementioned application is hereby incorporated herein by reference.

FIELD OF THE INVENTION

The invention is directed to a system and method for dry cleaning articles using a siloxane solvent. More specifically, the invention is directed to a system and method for regenerating a siloxane dry cleaning solvent using clays, powders, filters, filter mediums and gasses. In one exemplary embodiment, the inventive system and method eliminates the need for distillation.

BACKGROUND OF THE INVENTION

Dry cleaning is a major industry throughout the world. In the United States alone, there are more than forty thousand dry cleaning machines. In Europe, there are more than 60,000 dry cleaners. More than 85% of these dry cleaners use machines constructed for use with a perchloroethylene solvent ("PERC"). While PERC remains a good cleaning solvent, it presents several major health and environmental hazards, evidenced by numerous lawsuits for ground contamination and legislation for controlling and/or eliminating the use of PERC as a dry cleaning solvent.

Despite its health and environmental hazards, PERC remains the most widely used dry cleaning solvent worldwide. Because the majority of dry cleaners use PERC as a cleaning solvent, the majority of dry cleaning machines are designed specifically for use with PERC, which has certain characteristics that influence the design of the equipment and the method for regenerating the solvent. For example, PERC has a boiling point of 256° F., thereby enabling use of an atmospheric still for solvent regeneration. Also, PERC has high solvency. Solvency is typically reported as a Kauri Butanol Value ("KBV"), and PERC has a KBV of over 90. The KBV is a measure of solvency and the ability of a solvent to solubilize hydrophobic impurities. PERC's high solvency enables the solubilization of many impurities. Consequently, distillation is an excellent method of PERC regeneration because the solubilized impurities are typically not volatile and therefore become part of the waste-stream or non-volatile residue ("NVR"). The NVR is treated as hazardous waste, and its disposal is regulated.

In other parts of the world, such as Japan, which has over 60,000 dry cleaners, petroleum distillates are widely used as the cleaning solvent. These petroleum distillates have high boiling points ranging from 300° F. to 400° F., making vacuum distillation necessary to reduce the boiling temperature. Systems using vacuum distillation are typically the most expensive dry cleaning systems. Also, petroleum distillates have low flash points, and are therefore strictly regulated to prevent fire and explosion.

Petroleum distillates have solvencies ranging from 27 to 40 KBV. While these petroleum distillates have solvencies much lower than that of PERC, they have proven to sufficiently solubilize many of the hydrophobic impurities that are present in the dry cleaning process. However, regeneration of petroleum distillates by distillation also creates a hazardous waste stream subject to regulated disposal. Also, petroleum distillates are categorized as volatile organic compounds ("VOCs") and present both health and environmental concerns. Like with PERC, distillation is an excellent method for regenerating petroleum distillates because the solubilized impurities are typically not volatile and therefore become part of the waste-stream or non-volatile residue ("NVR"). The NVR is treated as hazardous waste, and its disposal is regulated.

in addition to distillation, filtration of these solutions also produces hazardous waste subject to regulated disposal. Prior to 1970, powder filters with diatomaceous earth were used for filtration. During the 1970s, however, these powder filters were widely replaced with cartridge filters. Then, in the 1980s, the U.S. Environmental Protection Agency ("EPA") categorized used cartridge filters as hazardous waste, making dry cleaners liable for the required special treatment and handling.

Regeneration of cleaning solvents through filtration and distillation is the largest source of hazardous waste in modern dry cleaning plants. This hazardous waste is both expensive to dispose of and is extremely unhealthy for the environment. As a result, the dry cleaning industry has focused its efforts on reducing this hazardous waste while maintaining good cleaning quality.

Due to environmental and government regulatory restraints, the industry's efforts have concentrated on developing alternatives to PERC and petroleum distillates. The search for alternative solvents has focused on environmental friendliness, functionality and economic practicality. These efforts led to the introduction of high flash point hydrocarbons, liquid carbon dioxide, glycol ethers, and more recently, siloxanes. Because siloxanes have only recently been introduced, systems and methods designed for their use as dry cleaning solvents are still needed.

SUMMARY OF THE INVENTION

The present invention is directed to a system and method for dry cleaning articles using a siloxane solvent. An exemplary system comprises a cleaning basket for receiving articles for cleaning and one or more tanks for containing a siloxane cleaning solvent. The system further comprises a pump located between the cleaning basket and the tank(s). The pump is used to move solvent and serves to immerse the articles in the siloxane solvent by pumping the solvent into the cleaning basket. In addition, the pump is used to mill the solvent during the wash cycle and to polish the solvent before use.

The system also comprises an air system for drying comprising a fan, heating coils, condensing coils and lint filters. In certain embodiments, the air system is remotely located relative to the cleaning basket, and acts as a transfer system for drying and recovery. These embodiments are particularly useful for cleaning natural apparel and textiles.

In one embodiment, the dry cleaning system further comprises a filtration system for regenerating the siloxane solvent. In this embodiment, no still for distillation need be used. In another embodiment, inert gases are introduced into the system to enhance cleaning ability.

BRIEF DESCRIPTION OF THE DRAWINGS

The above and other features and advantages of the present invention will become more apparent by reference to the following detailed description when considered in conjunction with the accompanying drawings in which:

FIG. 3 is a schematic illustrating a process of solvent regeneration according to one embodiment of the present invention;

FIG. 4 is a schematic illustrating a process of cleaning an article according to one embodiment of the present invention; and FIG. 5 is a schematic illustrating a process of cleaning an article according to an alternative embodiment of the present invention.

DETAILED DESCRIPTION OF THE INVENTION

Figure 1:
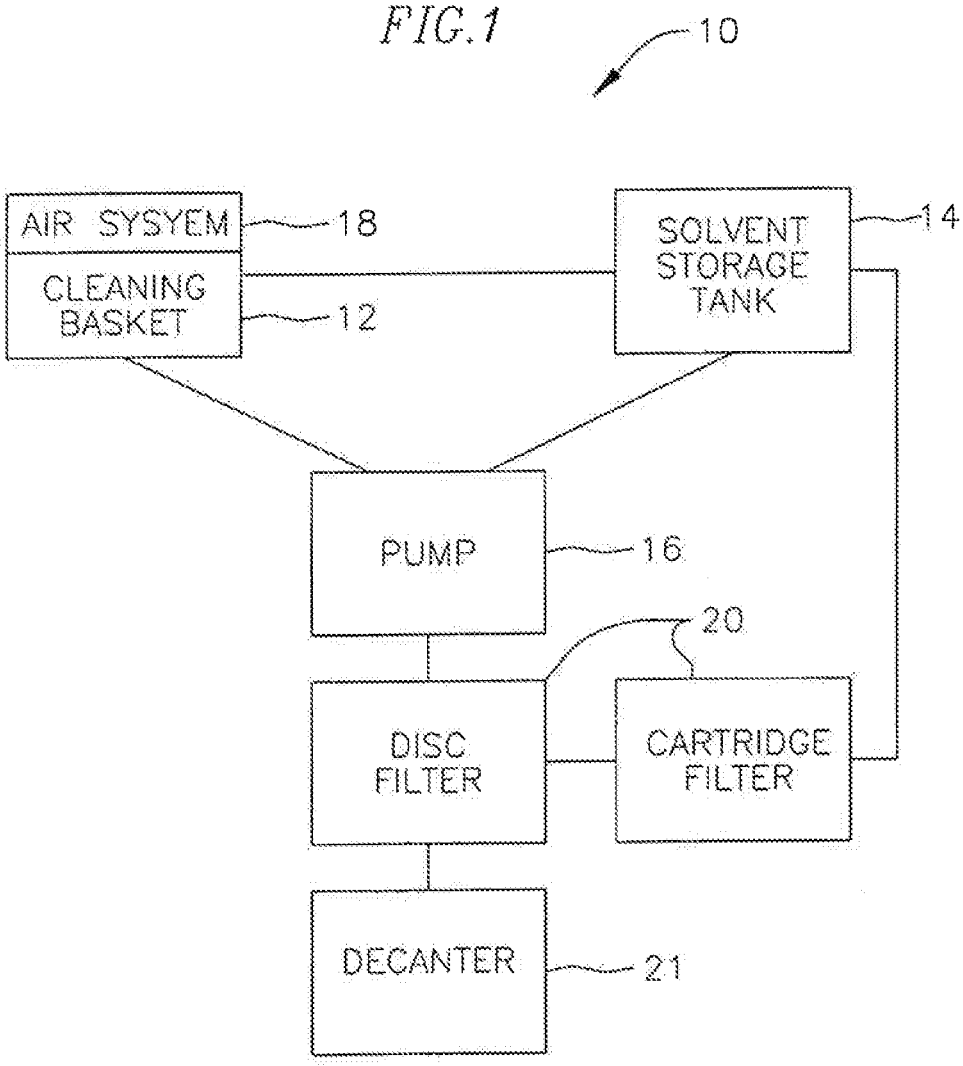
FIG. 1 is a schematic illustrating a dry cleaning system according to one embodiment of the present invention.

In one embodiment, the present invention is directed to a system and method for dry cleaning articles using a siloxane solvent. The siloxane solvent used in the systems of the present invention may comprise an organo-silicone, i.e. an organic/inorganic hybrid solvent. Organo-silicones useful with the present invention include cyclic siloxanes and linear siloxanes. The chemical characteristics of these cyclic and linear siloxanes allow the dry cleaning systems according to an exemplary embodiment of the present invention to operate without dependency on distillation.

Any suitable cyclic or linear siloxane can be used with the present invention, such as those described in U.S. Pat. No. 6,042,618, entitled DRY CLEANING METHOD AND SOLVENT, issued Mar. 28, 2000, the entire contents of which are incorporated herein by reference. Of these siloxanes, decamethyl-cyclopentasiloxane, a pentamer commonly referred to as D5, is presently preferred. Applicant unexpectedly discovered that although D5 does not solubilize impurities, the solvent does suspend impurities.

In addition to D5, cyclic siloxanes that are lipophilic and that have surface tensions less than about 18 dynes per square centimeter are preferred. Of the major cleaning solvents, silicone has the lowest surface tension, with a value of about 18 dynes per square centimeter. In comparison, petroleum distillates have a surface tension ranging from 22 to 24 dynes per square centimeter, PERC has a surface tension of 32 dynes per square centimeter, and water has a surface tension of 72 dynes per square centimeter. These differences between dry cleaning solvents are highlighted in Smallwood, Ian, "Solvent Recovery Handbook," 1993, the entire content of which is incorporated herein by reference. The low surface tension of the silicone solvents allows them to release impurities from articles being cleaned and then suspend the impurities. Also, due to the low surface tension and low solvency of siloxane solvents, filter pressure is not significantly increased as impurities are adsorbed and absorbed. Therefore, solvent flow rate is not significantly hindered, as it is with other solvents.

Cyclic siloxanes having the desired characteristics have better flow rates through regenerative filters, as noted above. These siloxanes, when used in conjunction with the appropriate detergents, are better able to suspend many of the impurities that are otherwise dissolved in more aggressive solvents, such as PERC and hydrocarbons. These more aggressive dry cleaning solvents, especially hydrocarbon solvents, solubilize too many impurities, and the solvent does not flow well through pre-coated filters, as noted in "Forschungsinstitut Hohenstein," Hohenstein Institute, Germany, the entire content of which is incorporated herein by reference. In addition, impurities can build up and the solvents with higher solvency will develop unpleasant odors. However, siloxane solvents do not solubulize the impurities and therefore do not accumulate odorous materials.

Because PERC and petroleum distillates are the most widely used dry cleaning solvents, and because these solvents have high solvency, distillation has been the method of choice for solvent purification. However, the siloxane solvents useful with the present invention have lower solvency. Specifically, D5 has a solvency of less than about 14 KBV. Although these siloxanes have lower solvency than PERC and petroleum distillates, when they are combined with an appropriate ionic, anionic or cationic detergent, the solvent/detergent mixture effectively suspends impurities. One exemplary detergent is an anionic detergent. Because the impurities are suspended in the solvent/detergent mixture, and are not solubilized by the solvent, the impurities can be removed by filtration, thus eliminating the need for distillation.

Because some impurities are hydrophilic, the use of water in the dry cleaning process can improve the cleaning quality. To remove these impurities, water can be added either by reintroducing hydrated solvent recovered from the drying process, by adding free water, or by adding an emulsion of water, detergent and siloxane solvent.

In one embodiment, an inert, soluble gas such as carbon dioxide and/or nitrogen is added to the cleaning system. The introduction of such a gas increases the ability of the solvent/detergent mixture to suspend impurities. In addition to improving impurity suspension, the introduction of these inert gasses reduces the volume of oxygen, thereby decreasing the likelihood of fire or explosion.

These gasses can be introduced into the solvent/detergent mixture during the cleaning process. For example, the gasses may be introduced during the wash process. In one exemplary embodiment, the gasses are injected into the pump manifold. However, because the machines are not vented during this process, the introduction of gasses may cause a slight pressure increase. Consequently, a pressure relief system may be provided such that if the pressure from the gas becomes too great, the system will relieve that pressure.

In another exemplary embodiment, an oxidizing gas such as ozone is added to the solvent/detergent mixture. Ozone may be added instead of or in addition to the inert gasses described above. The controlled introduction of an oxidizing gas helps eliminate odorous impurities, as noted in "Ozone as an Aid to Coagulation and Filtration," *American Water Works Association,* 1993, the entire content of which is incorporated herein by reference. Ozone is particularly useful in this regard. Ozone is a radical and its molecular structure has an affinity for odorous molecules. In fact, residual odor tests conducted according to ASTM D1296 revealed improvements in odor when ozone was used to clean articles having odorous impurities. However, ozone has a very short half life, typically less than about 21 minutes, and therefore must be created and immediately introduced into the solvent/detergent mixture.

Ozone should only be used with the siloxane solvents used in the present invention. Ozone should not be used with petroleum distillates or with hydrocarbon solvents. Due to its oxidizing characteristics, ozone can alter the hydrocarbon structure, which may result in lower flash points and unsafe conditions. In contrast, applicant has discovered that siloxane solvents such as D5 carry ozone well, without experiencing alterations in solvent structure.

As illustrated in FIG. 1, an exemplary system 10 comprises a cleaning basket 12 for receiving articles for cleaning and one or more tanks 14 for containing a siloxane cleaning solvent. The system 10 further comprises a pump 16 located between the cleaning basket 12 and the tank(s) 14. The pump 16 serves to immerse the articles in the siloxane solvent by pumping the solvent from tank 14 into the cleaning basket 12. In one exemplary embodiment, more than one pump may be used. The system 10 also includes an air system 18 for drying. In an exemplary embodiment, the air system includes a fan, heating coils, condensing coils and lint filters. In other exemplary embodiments, the air system 18 is remotely located relative to the cleaning basket 12, and acts as a transfer system for drying. These other exemplary embodiments are particularly useful for cleaning natural apparel and textiles.

The system 10 further comprises a filtration system 20 for regenerating the siloxane solvent. Filtration performance depends on several variables, including filter selection, filter pressure and solvent flow rate, as discussed in "Filters, Filter Pressure, and Flow Rate," *International Fabricare Institute Bulletin*, No. 608, the entire contents of which are incorporated herein by reference, and in "Filtration Technology," *Parket Hannifin Corp*., 1995, the entire content of which is incorporated herein by reference. Different filters and/or filtration systems may perform differently. Also, coated filters may perform differently from uncoated filters, as noted in "Disc Filtration Performance Data," *Technical Operating Information International Fabricare Institute Bulletin*, No. 652, the entire contents of which are incorporated herein by reference.

To effect filtration, any filter may be used, such as those described in "Filter Mediums," *Industry Focus From the International Fabricare Institute*, No. 1 (March 1995), the entire contents of which are incorporated herein by reference. In particular, cartridge filters can be used for siloxane solvent regeneration, as noted in U.S. Pat. No. 6,086,635, entitled SYSTEM AND METHOD FOR EXTRACTING WATER. IN A DRY CLEANING PROCESS INVOLVING A SILOXANE SOLVENT, issued Jul. 11, 2000, the entire contents of which are incorporated herein by reference. Use of these cartridge filters can effect a reduction in the waste stream while maintaining cleaning quality.

However, disc filters are also useful with the present invention. In particular, non-limiting examples of disc filters useful with the present invention include spin disc filters, tubular filters, flex-tubular filters and the like. In an exemplary embodiment, spin disc filters are used, such as those described in "Disc Filtration," *International Fabricare Institute Bulletin*, No. 620, the entire contents of which are incorporated herein by reference. In one exemplary embodiment, a 30 to 35 micron spin disc filter is used. In an alternative exemplary embodiment, a 60 micron spin disc filter is used. These exemplary spin disc filters each have a septum which acts as a foundation for supporting a filtration medium, which can include a clay or powder. The septum comprises several openings through which the solvent is allowed to pass. However, because the suspended impurities are larger than the openings in the septum, they do not pass through the openings. The 60 micron filters are preferably pre-coated as described below. In this embodiment, the filtration medium pre-coat bridges the larger openings of the filter septum and traps the suspended impurities.

The 30 to 35 micron filters can also be pre-coated for use with the siloxane solvents of the present invention. The low surface tension of the siloxane solvents allows the 30 to 35 micron filters to be pre-coated without significantly decreasing the flow rate through the filter. In contrast, pre-coated 30 to 35 micron filters cannot be effectively used with traditional solvents. The flow rate of such solvents through a pre-coated 30 to 35 micron filter is prohibitively slow.

Figure 2:
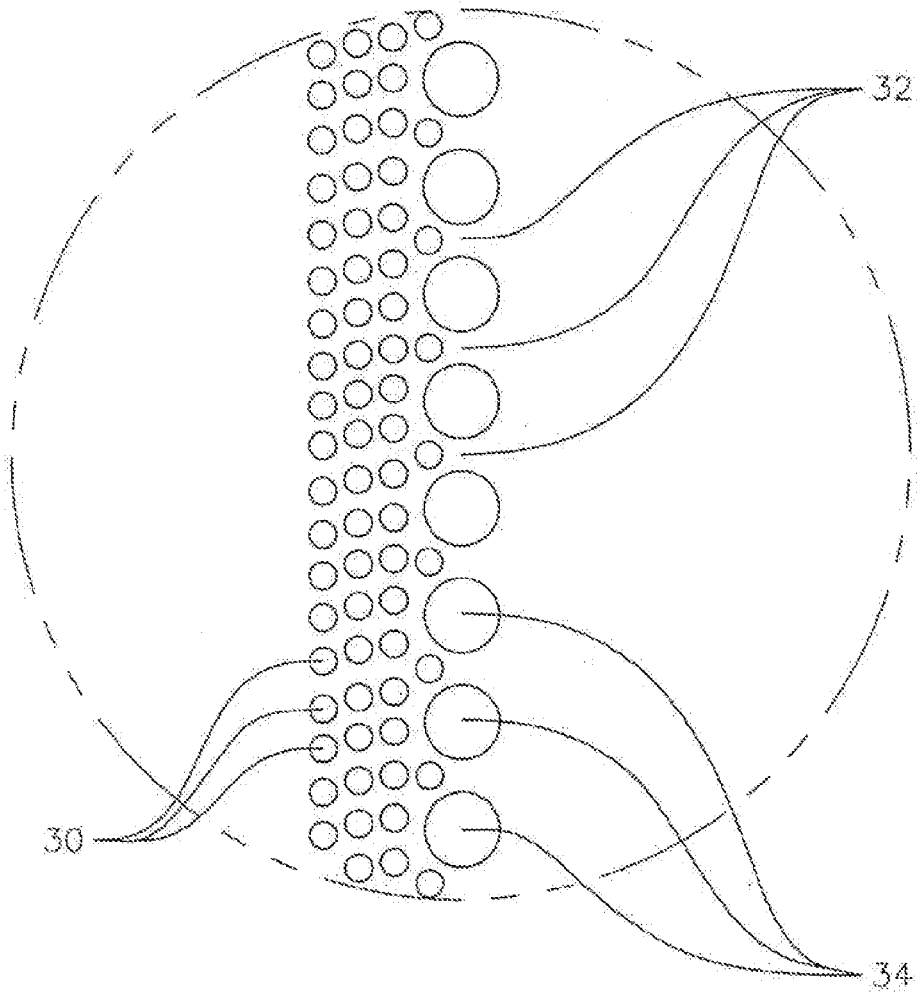
FIG. 2 is an enlarged cross-sectional view of a pre coated spin disc filter according to one embodiment of the present invention.

For pre-coating the spin disc filters, in an exemplary embodiment, fine particles of a filtration medium are used. As shown in FIG. 2, these fine particles 30 bridge the openings 32 of the filter septum 34, creating smaller openings through which the solvent passes. When the solvent passes through the filtration medium and the septum 34, the impurities suspended in the solvent are trapped in the filtration medium. In one exemplary embodiment, the filtering medium is used in an amount ranging from about 0.04 to about 1 pound per square foot of filter surface area.

In one exemplary embodiment, the filtering medium may include clays and/or powders. Although some clays and/or powders have been used in dry cleaning processes using other solvents, these clays and/or powders may not be useful with the siloxane solvents used in the present invention. Applicant has discovered that due to their pH levels, many of these clays may solidify or oligomerize when exposed to siloxane solvents for an extended period of time. While the pH levels of these clays does not affect the usefulness of the clays with other solvents, such as PERC or petroleum distillates, the pH levels of these clays completely negate the usefulness of the clays with siloxane solvents. However, applicant has discovered that specific clays, having pH levels close to neutral, can be used with siloxane solvents without solidifying or oligomerizing. These clays are compatible with siloxane solvents and do not solidify and/or oligomerize when exposed to siloxane for extended periods of time.

In another exemplary embodiment of the present invention, any filtration medium may be used that is compatible with a siloxane solvent. One such suitable filtration medium has a bulk density ranging from about 300 to about 700 g/l and a pH ranging from about 5 to about 8. The filtration medium may also comprise a highly active bleaching earth that possesses an affinity for polar impurities, dyes and other impurities, such as fatty acids, fats and oils. Exemplary embodiment filtration mediums include silicone-based clays.

Non-limiting examples of suitable filtration mediums include zeolites and polystyrene beads. Zeolites are hydrated aluminosilicates having open crystal structures. These zeolites effectively absorb particles having particular sizes, such as those particles that may be suspended in a siloxane dry cleaning solvent. Polystyrene beads are also effective filtering mediums for use with siloxane solvents. The particle sizes of these beads relative to the size of the pores in the filter septum makes these beads useful filtering mediums.

Other exemplary filtration mediums include activated clays. Such clays are typically activated using acids which acids effect the Lewis acid sites in the clay. These Lewis acid sites greatly influence the oligomerization of the clay when exposed to the siloxane solvent for extended periods of time. Because of this oligomerization phenomenon, the activated clays should not be left in the system with the solvent after the system has been turned off or when the filter is to be regenerated. For this reason, when the filter is ready to be regenerated, the vessel containing the siloxane solvent is drained to minimize exposure of the clays to the solvent.

Another filter pre-coat may include a mixture of diatomaceous earth powder and another clay. Diatomaceous earth, by itself, is a good filtration powder, as noted in Fulton, George P., "Diatomaceous Earth Filtration for Safe Drinking Water," *American Society of Civil Engineers,* 2000, the entire content of which is incorporated herein by reference. However, this mixture of diatomaceous earth with another clay achieves improved water absorption and improved cleaning results. In one exemplary embodiment, when such a mixture is used, the weight ratio of clay to diatomaceous earth powder ranges from about 1:1 to about 1:4. The total amount of the mixture used for the pre-coat ranges from about 0.04 to about 1 pound per square foot of filter surface area.

In one exemplary embodiment, a single filter housing containing all carbon cartridge filters may be used in addition to the pre-coated filter. In this embodiment, the solvent passes through the carbon cartridges after passing through the pre-coated filter. The exposure of the solvent to the additional carbon cartridge filters is used to adsorb a high volume of dyestuffs.

After a number of cleaning cycles or pounds of articles cleaned, the pre-coated filter may be regenerated. When using other dry cleaning solvents, the decision to regenerate has traditionally been based on filter pressure and/or the color of the solvent after cleaning. However, unlike other dry cleaning solvents, siloxane solvents have low surface tension and are less aggressive on solubilized dyestuffs. Therefore, siloxane solvents do not become significantly colored during cleaning, and filter pressure is not significantly increased, thus not reducing flow rate. Accordingly, when used with siloxane solvents, the decision to regenerate the filter may be based on pounds of articles cleaned.

However, as noted above, extended exposure of the activated clay pre-coat to the siloxane solvent should be avoided. Extended exposure of the clays to the siloxane solvents may cause the solidification and/or oligomerization. This oligomerization and or solidification can damage the dry cleaning equipment. To prevent this from occurring, the filter housing should be drained of used solvent and used clays and/or powders prior to periods of extended non-operation.

Regeneration of pre-coated disc filters has traditionally involved spinning the discs to centrifuge the used pre-coat which drains into a sealed container or still. Once collected in the still, the solvent, which contains impurities, and the used pre-coat are distilled to remove the impurities and regenerate the solvent for future use.

Sealed containers have historically been required because of the classification of the cleaning solvents used. PERC, petroleum distillates and hydrocarbon dry cleaning solvents are classified either as volatile organic compounds ("VOCs"), hazardous air pollutants ("HAPs") or toxic air contaminants ("TACs"). By virtue of their classification as such, disposal of the waste generated from use of these solvents is strictly regulated. These regulations require the use of a sealed container to collect the spin off from the disc filters.

However, siloxane solvents are not classified as either VOCs, HAPs or TACs. Therefore, the used pre-coat does not need to be drained into a sealed container. Instead, the waste can be collected in a non-sealed container which can include an internal filtration element such as a cloth bag, which allows the solvent to pass but which retains the particulate material.

Furthermore, as described, above, siloxane solvents do not solubilize the impurities. Rather, these siloxane solvents suspend the impurities, which are later removed by filtration.

In use, in one exemplary embodiment, the disc filter is first pre-coated by placing from about 0.04 to about 1 pound per square foot of filtration medium into a cleaning basket and pumping the siloxane solvent into the basket. A cloth bag may be situated at the bottom of the cleaning basket to prevent the filtration medium from passing through the openings in the bottom of the basket. The cloth bag may comprise the cloth bag, described below, that is removed from the vessel and extracted, as described in more detail below. The solvent/filtration medium mixture is then agitated by rotating the basket once submerged in the solvent.

The solvent/filtration medium mixture is then pumped to the filter housing, and the solvent is circulated between the cleaning basket and filter housing until the solvent is substantially clear. As the solvent passes through the filter, the filtration medium settles on the disc filter, creating a pre-coated filter.

FIG. 3 illustrates an exemplary process by which a disc filter is regenerated. To regenerate the filter after a number of cleanings, the disc filter is centrifuged to remove the accumulated clay/powder including the filtered impurities. The removed solvent, clay and impurities then drain into the vessel, which can comprise a filtering medium, such as a cloth bag, to collect the clay and impurities, while allowing the solvent to pass. The drained solvent then drains back into a tank for reuse. This process can be repeated as needed to remove any remaining clay or powder from the disc filter.

Once the drained material empties into the cloth bag in the vessel, the bag containing the used clay or powder is then secured and placed back into the cleaning basket for extraction, to ensure little to no loss of solvent. The solvent is then extracted by centrifuging the cleaning basket. After centrifuging, the powder is brushed from the cloth bag and discarded according to local regulations.

Prior to regeneration of the filter, or when the system is not to be operated for an extended period of time, the solvent should be removed from the system to prevent extended exposure of the filtering medium to the siloxane solvent. Accordingly, in one exemplary embodiment, when the filter is turned off or is not under filter pressure, the solvent and filtering medium drains from the filter housing to a decanter 21, as generally shown in FIG. 1. The decanter 21 may include a filtration element such as a cloth bag that catches the filtration medium but allows the solvent to pass. Once the solvent and filtration medium are passed through the filtration element, the cloth bag with the caught filtration medium is removed from the decanter 21.

Similarly, when the filter is ready for regeneration, the solvent from the filter housing is directed to the cleaning basket. The filter housing includes a vent line which is also directed to the cleaning basket. By this configuration, the solvent is moved from the filter housing to the cleaning basket and is then moved through the filter before being stored in the storage tank(s). By removing as much filtration medium as possible from the solvent being stored in the storage tank(s), this configuration minimizes contact of the filtering medium with the siloxane solvent.

FIG. 4 illustrates an exemplary process by which an article is cleaned using a regenerative filter. To clean an article using the filter generated as described above, the article is first placed in the cleaning basket. The siloxane solvent is then pumped into the cleaning basket and detergent may be added to the solvent in the cleaning basket. The solvent/detergent mixture is then milled by circulating the solvent/detergent mixture in the cleaning basket. This milling allows the detergent to attach to hydrophilic impurities in the articles being cleaned. During the milling process, the solvent/detergent mixture is not filtered in order to allow the detergent time to attach to the hydrophilic impurities. As the mixture is milled, the impurities in the articles are suspended in the solvent. The milling is continued for a length of time determined by the detergent manufacturer's recommendations. Typically, however, the milling continues from about 2 to about 8 minutes.

After milling of the solvent/detergent mixture and suspension of the impurities, the wash cycle begins and the solvent/detergent mixture with suspended impurities is pumped through the filter for filtration and removal of particulates and impurities. The solvent is then drained back to the tank. The cleaning basket is then centrifuged to remove as much solvent as possible from the articles being cleaned.

In one exemplary embodiment, after centrifuging the cleaning basket, the article is dried at a temperature ranging from about 130° F. to about 168° F., as measured in the outlet air from the basket. During drying, the solvent is circulated from the tank through the filter for purification and polishing. Polishing refers to the process by which the solvent is cleaned for reuse and includes pumping the solvent from the storage tank to the filter and back to the storage tank. This process removes impurities from the solvent. Purification and polishing may continue until the drying process is completed. Because the drying process is the longest process in the cleaning cycle, the solvent is exposed to the filter housing for purification for a considerable amount of time.

In addition to being circulated through the filter housing and tank, the solvent may also be circulated through a separate filter such as a cartridge filter. As noted above, the cartridge housing is particularly useful for removing dye-tuffs.

After drying is complete, the cleaned and dried articles are cooled prior to removal from the cleaning basket. In one exemplary embodiment, the articles are cooled to a temperature ranging from about 80° F. to about 115° F. Cooling of the articles prevents the articles from becoming wrinkled.

FIG. 5 illustrates another exemplary process by which an article is cleaned using a regenerative filter. First, the article is placed in the cleaning basket. The siloxane solvent is then pumped into the cleaning basket and detergent is added to the solvent in the cleaning basket. The entire machine is then sealed to create a closed environment. While the solvent/detergent mixture is milled by pumping to and from the cleaning basket, small volumes of an inert gas and/or an oxidizing gas are injected into the machine. Preferably, the inert gas and/or oxidizing gas is injected into the solvent flow. The introduction of the gas at this stage of the cleaning cycle improves impurity suspension and enhances the elimination of odorous impurities.

During agitation of the solvent/detergent mixture and suspension of the impurities, the solvent/detergent mixture can be pumped through the filter for removal of the impurities. The solvent is then drained back to the tank. The injection of the inert gas and/or oxidizing gas is then terminated and the cleaning basket is centrifuged to remove as much solvent as possible.

In one exemplary embodiment, after centrifuging the cleaning basket, the article is dried at a temperature ranging from about 130° F. to about 168° F., as measured in the outlet air from the basket. During drying, the solvent is circulated from the tank through the filter for regeneration and polishing. This process is repeated until the drying process is completed. Because the drying process is the longest process in the cleaning cycle, the solvent is exposed to the filter housing for regeneration for a considerable amount of time.

In one exemplary embodiment, in addition to being circulated through the filter housing and tank, the solvent may also be circulated through a separate filter such as a cartridge filter. As noted above, the cartridge housing is particularly useful for removing dyestuffs. However, it is understood that the step of circulating the solvent through the cartridge filter is optional. Alternatively, a mechanism may be provided for bypassing the cartridge filter to prevent the solvent and filtration medium from passing through the cartridge filter. Such a system is useful during pre-coating of the spin disc filters. In this regard, the solvent bypasses the cartridge filter so that the filtration medium does not build up in the cartridge filter.

After drying is complete, the cleaned and dried articles are cooled prior to removal from the cleaning basket. In one exemplary embodiment, the articles are cooled to a temperature ranging from about 80° F. to about 115° F. Cooling of the articles prevents the articles from becoming wrinkled.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention. For example, filter other types of filters, which may not be disc filters, and which are capable of being re-generated. Accordingly, the foregoing description should not be read as pertaining only to the precise embodiments described and illustrated in the accompanying drawings, but rather should be read consistent with and as support for the following claims which are to have their fullest and fairest scope.

What is claimed is:

1. A method of regenerating a filter that has been used to clean articles with a siloxane solvent, the filter including a filtering medium comprising an activated clay, the method comprising: agitating the filter to remove the filtering medium and impurities trapped in the filtering medium; passing the siloxane solvent used during the cleaning of the articles, the filtering medium and the impurities through a filtering element which collects the filtering medium and impurities but allows the solvent to pass; and collecting the solvent passed through the filtering element for reuse, wherein the filter is regenerated for preventing oligomerization of the filtering medium.

2. The method according to claim 1, wherein the filter comprises a spin disc filter and the filtering medium is removed by rotating the spin disc filter.

3. The method according to claim 1, wherein the filter comprises a tubular filter and the filtering medium is removed by centrifuging.

4. The method according to claim 1, wherein the filtering element comprises a cloth bag.

5. The method according to claim 1, further comprising: extracting solvent from the filtering medium collected in the filtering element; and collecting the extracted solvent for reuse.

* * * * *